US008079167B1

(12) United States Patent
Overstreet

(10) Patent No.: US 8,079,167 B1
(45) Date of Patent: Dec. 20, 2011

(54) MUZZLE LOADING RIFLE WITH CENTERFIRE CARTRIDGE IGNITION

(76) Inventor: John L. Overstreet, Fayette, MO (US)

( * ) Notice: Subject to any disclaimer, the term of this patent is extended or adjusted under 35 U.S.C. 154(b) by 371 days.

(21) Appl. No.: 12/361,683

(22) Filed: Jan. 29, 2009

Related U.S. Application Data

(60) Provisional application No. 61/024,268, filed on Jan. 29, 2008.

(51) Int. Cl.
*F41C 9/08* (2006.01)

(52) U.S. Cl. ..... 42/51; 89/1.3

(58) Field of Classification Search ..... 42/51; 89/1.3
See application file for complete search history.

(56) References Cited

U.S. PATENT DOCUMENTS 5,632,109 A * 5/1997 Caudle ..... 42/51
5,706,598 A * 1/1998 Johnston ..... 42/51
6,314,670 B1 * 11/2001 Rodney, Jr. ..... 42/51
6,385,887 B1 * 5/2002 Johnston ..... 42/51
7,526,888 B1 * 5/2009 Joyce ..... 42/51
7,877,919 B2 * 2/2011 Richards ..... 42/51
2005/0115129 A1 * 6/2005 Lizarralde et al. ..... 42/51
2008/0092420 A1 * 4/2008 Simms ..... 42/51

* cited by examiner

*Primary Examiner* — Michael Carone
*Assistant Examiner* — Joshua Freeman
(74) *Attorney, Agent, or Firm* — Taylor IP, P.C.

(57) ABSTRACT

A muzzleloading rifle includes an action and a barrel assembly attached to a forward end of the action. The barrel assembly includes a barrel, a barrel extension and an intervening wall. The barrel has a breach end, a muzzle end and a primary chamber at the breach end for receiving a primary charge loaded through the muzzle end. The barrel extension is attached to the breach end of the barrel and includes a casing chamber positioned rearwardly from the primary chamber. The casing chamber is configured to receive a standard ammunition casing with an integral primer therein. The intervening wall separates the primary chamber from the casing chamber. The intervening wall includes a flash hole communicating between the casing chamber and the primary chamber.

19 Claims, 4 Drawing Sheets

MUZZLE LOADING RIFLE WITH CENTERFIRE CARTRIDGE IGNITION

CROSS-REFERENCE TO RELATED APPLICATIONS

This is a non-provisional application based upon U.S. provisional patent application Ser. No. 61/024,268, entitled "MUZZLE LOADING RIFLE WITH CENTERFIRE CARTRIDGE IGNITION", filed Jan. 29, 2008.

BACKGROUND OF THE INVENTION

1. Field of the Invention

The present invention relates to muzzle loading rifles, and, more particularly, to ignition systems for muzzleloading rifles.

2. Description of the Related Art

Muzzle loading rifles were the first type of firearms used by humans. Historically, such rifles can be categorized by the particular type of ignition system used to ignite the black powder propellant. First were wheel lock rifles, followed by flintlock rifles, then percussion rifles, and more recently, inline rifles.

Wheel lock rifles were first used in China and have a rotating lock carrying a fuse which passes through a hole in the barrel and ignites the black powder. Flintlock rifles use a piece of flint stone carried at the end of a rotating hammer to ignite a powder charge in a striker pan, which in turn sends a flame through a flash hole to the primary black powder charge in the barrel. Percussion rifles are similar in design, except that the hammer ignites a percussion cap placed on a nipple. The percussion cap has an incendiary compound which produces a flame, which passes through a flash hole to the primary powder charge in the barrel. Modern inline muzzleloaders typically have a removable breach plug at the rear of the barrel. The breach plug is machined to receive a standard 209 primer and has a flash hole extending to the primary powder charge in the barrel. The 209 primer is a standard primer used in most centerfire shotgun ammunition, and produces a hotter flame than a percussion cap. Thus, the chances of a misfire or hangfire using an inline muzzleloader are less than with the other type of muzzle loading ignition systems described above.

The most commonly used ignition systems today for muzzle loaders are the percussion and inline ignition systems. Both types of ignition systems require that a user handle small parts—percussion caps in the case of percussion rifles and 209 primers in the case of inline rifles. Some users may find this task difficult to carry out.

Further, regardless of the type of muzzle loader used, all muzzle loaders to date have the disadvantage of not being able to be used in what is normally thought of as a centerfire rifle. At least one manufacturer of rifles has a modular system allowing a user to mix and match barrels, calibers, stock types, etc, but the selected rifle is still just a common muzzle loader with a conventional ignition system.

What is needed in the art is a muzzle loader with an ignition system which is easier to use and adaptable to conventional center fire rifle frames.

SUMMARY OF THE INVENTION

The present invention provides a muzzleloading rifle with a conventionally muzzle loaded primary charge within the barrel, and a separate centerfire cartridge with an integral typical or atypical primer for igniting the charge within the primary chamber in the barrel.

The invention in one form is directed to a muzzleloading rifle, including an action and a barrel assembly attached to a forward end of the action. The barrel assembly includes a primary chamber for receiving a primary charge, and a casing chamber positioned rearwardly from the primary chamber. The casing chamber is configured to receive a standard ammunition casing with an integral primer therein. An intervening wall separates the primary chamber from the casing chamber. The intervening wall includes a flash hole communicating between the casing chamber and the primary chamber.

The invention in another form is directed to a muzzleloading rifle, including an action and a barrel assembly attached to a forward end of the action. The barrel assembly includes a barrel, a barrel extension and an intervening wall. The barrel has a breach end, a muzzle end and a primary chamber at the breach end for receiving a primary charge loaded through the muzzle end. The barrel extension is attached to the breach end of the barrel and includes a casing chamber positioned rearwardly from the primary chamber. The casing chamber is configured to receive a standard ammunition casing with an integral primer therein. The intervening wall separates the primary chamber from the casing chamber. The intervening wall includes a flash hole communicating between the casing chamber and the primary chamber.

An advantage of the present invention is that an action of a centerfire rifle may be operated in a typical fashion to ignite the black powder charge within the primary chamber in the barrel.

Another advantage is that the centerfire casing can be configured to accept a typical primer for such a casing, or a different (e.g., hotter) primer for such casing.

Yet another advantage is that the centerfire casing is easier for an operator to handle and load than a typical percussion cap or 209 shotgun primer by itself.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
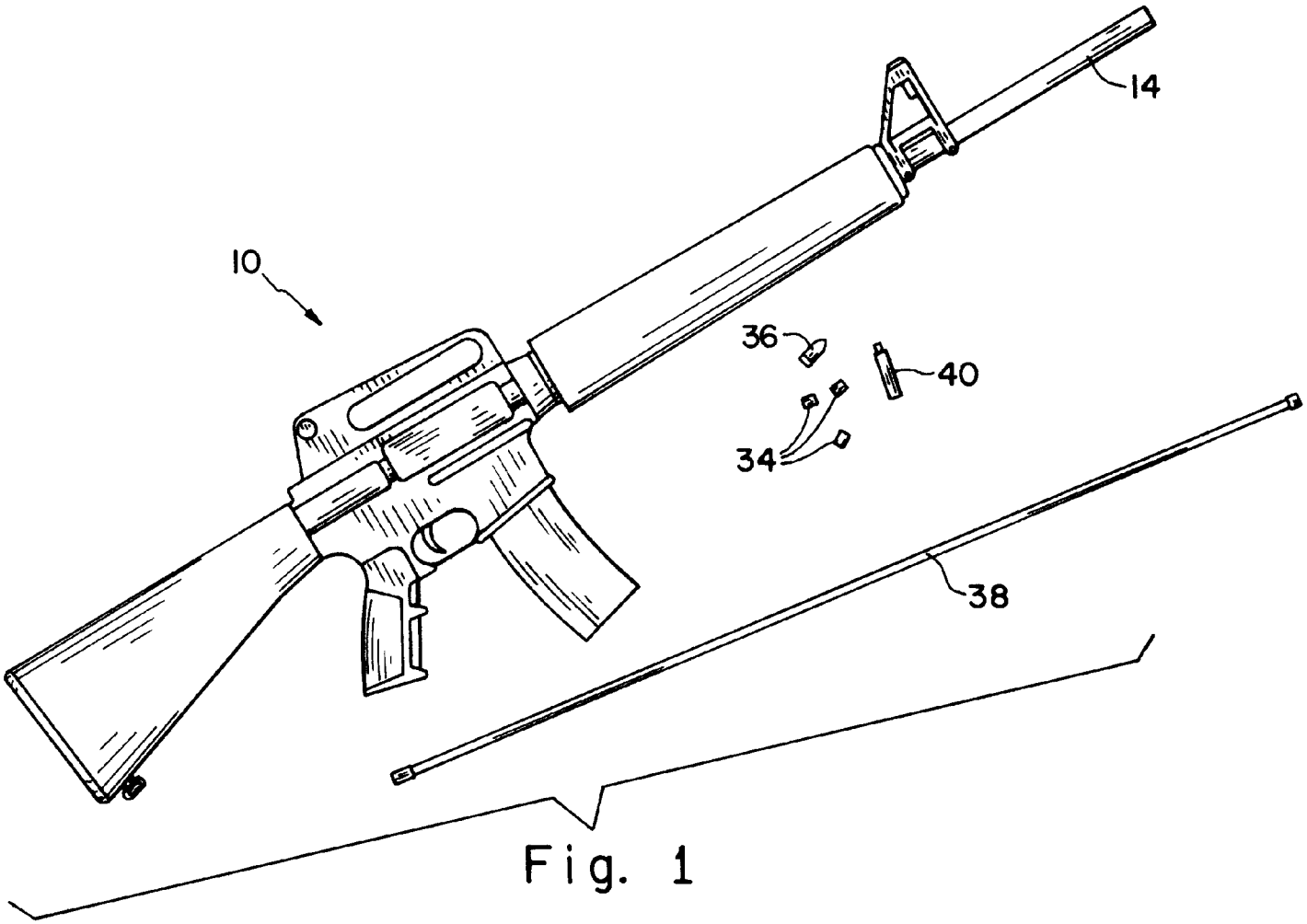
FIG. 1 is a perspective side view of an embodiment of a muzzle loading rifle of the present invention.

Referring now to the drawings, and more particularly to FIG. 1, there is shown an embodiment of a muzzle loading rifle 10 of the present invention. In the illustrated embodiment, muzzle loading rifle 10 is configured as an AR15 style rifle. The M16/AR15 rifles are used worldwide by military and law enforcement organizations and civilian sport enthusiasts. M16 and AR-15 rifles are substantially the same, except that the M16 is switchable between automatic and semi-automatic operation, and the AR15 operates only in the semi-automatic mode. As a result, most of the components of M16 and AR15 rifles are substantially the same and are referred to as M16/AR15 components.

An AR15 is generally constructed in modular "groups" allowing easy takedown and cleaning in the field. The upper receiver group generally includes the upper portion of the receiver, barrel, top rail and forestock. The lower receiver group includes the trigger assembly and pistol grip. The buttstock extends rearwardly from the lower receiver group and allows the rifle to be shouldered by a user.

Rifle 10 is similar to other AR15 style rifles, with the primary difference being in the barrel which is attached to the upper receiver. The barrel is different in two respects: First, the barrel is machined to accommodate a typical muzzle loader charge which is loaded from the distal end of the barrel. Second, the barrel is machined with a chamber for receiving a standard ammunition cartridge at the proximal end of the barrel.

Figure 2:
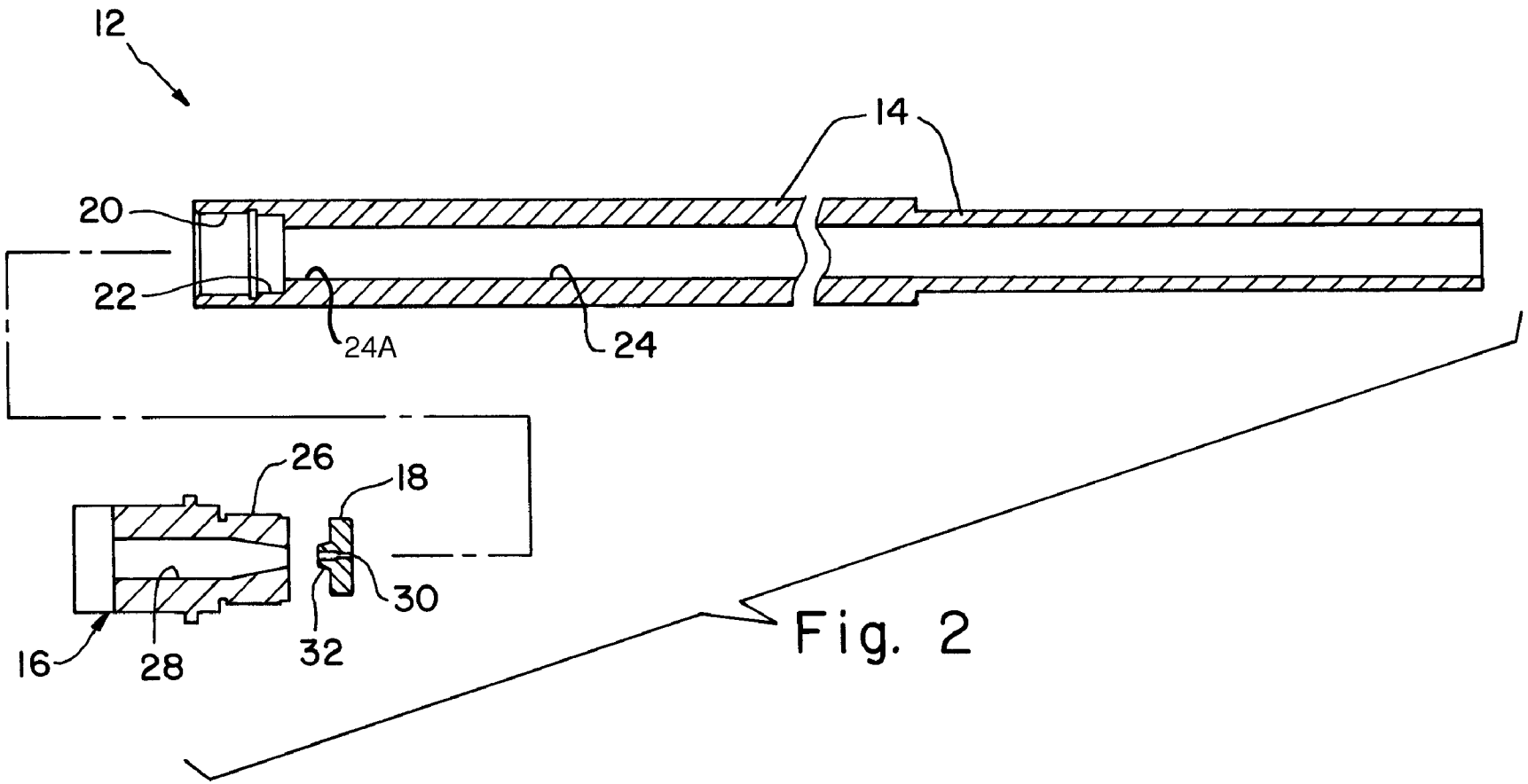
FIGS. 2-3 are sectional, side views through the barrel and barrel extension of the muzzle loading rifle shown in FIG. 1.
Figure 3:
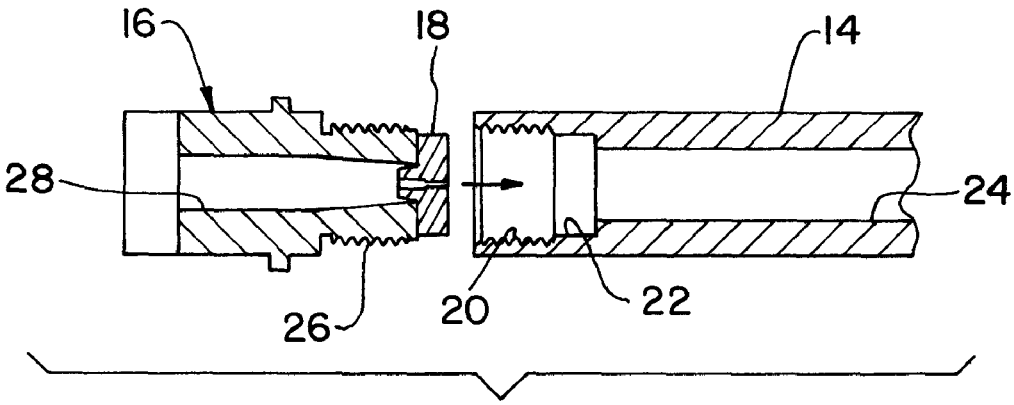
Figure 4:
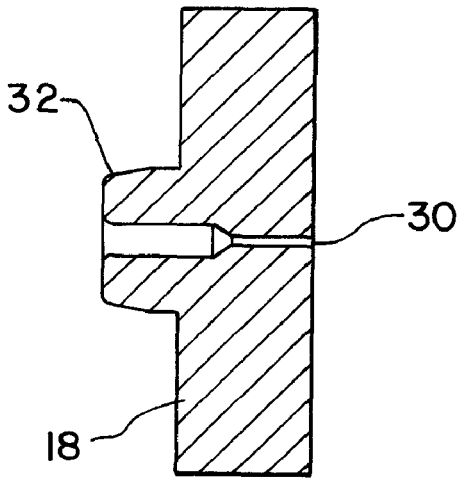
FIG. 4 is a side sectional view through the disk shown in FIGS. 2 and 3.

Referring to FIGS. 2-4, a barrel assembly 12 generally includes a barrel 14, barrel extension 16, and disk 18. Barrel 14 includes an internally threaded recess 20 at the proximal end with a stepped shoulder 22 having a slightly smaller inside diameter. Stepped shoulder 22 is sized to receive disk 18 therein. Barrel 14 also has a bore 24 for passage of a projectile, which is configured as a rifled 0.50 caliber bore in the illustrated embodiment. Bore 24 defines a primary chamber 24A at the breach end of barrel 14 with the same diameter as the remainder of bore 24. A gun powder charge and projectile are introduced through the muzzle end of barrel 14 to be seated within primary chamber 24A at the breach end of barrel 14. The gun powder charge is typically black powder or pyrodex, although some muzzleloaders are also configured to fire smokeless powder. The projectile can be any suitable configuration, such as a round ball, maxi ball, saboted projectile, etc.

Barrel extension 16 has an exteriorly threaded shoulder 26 which is sized to thread into threaded recess 20 of barrel 14. Barrel extension 16 also has a casing chamber 28 which is sized and shaped to receive a standard cartridge casing, such as a 0.223 inch, 0.243 inch, 0.270 inch, 0.308 inch, 30-06, etc. In the embodiment shown, casing chamber 28 is sized and shaped to receive a standard 0.223 cartridge casing. The casing does not include propellant or a projectile, and the standard centerfire rifle primer is replaced with a standard 209 shotgun primer. The 209 shotgun primer is generally preferred over a centerfire rifle primer for muzzleloader applications. It is possible, however, that other types of primers can be used, such as a centerfire primer for a standard 0.223 cartridge, or other type of primer for a small rifle, large rifle, small pistol, large pistol, and magnum small and large pistol. The 209 primer is larger in diameter than a centerfire rifle primer, and therefore the primer pocket on the 0.223 casing is enlarged to accommodate the 209 primer. The 0.223 ammo may be loaded in a conventional magazine, and the action may be operated (charged) in a normal manner to place the cartridge casing in casing chamber 28.

The disk 18 between the 0.223 casing and the primary charge at the breach end of barrel 14 is sized to fit within stepped shoulder 22 in barrel 14, and has a thickness corresponding to the thickness of stepped shoulder 22. Disk 18 is clamped between barrel extension 16 and the seat adjacent stepped shoulder 22 upon tightening the threads between threaded recess 20 and threaded shoulder 26. Disk 18 also includes a flash hole 30 and a nipple 32. Flash hole 30 may be of conventional design. Nipple 32 extends into the distal end of casing chamber 28 (see FIG. 2) and prevents a live cartridge casing (including a projectile) from being accidentally loaded into casing chamber 28.

Figure 5:
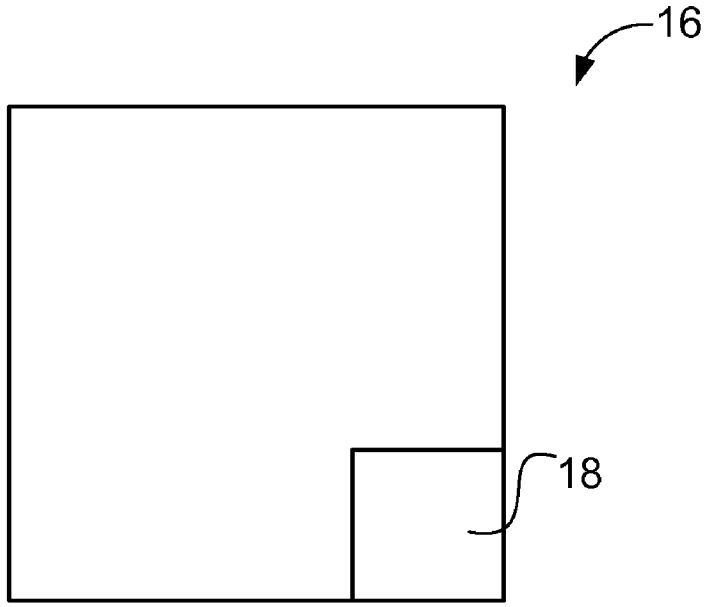
FIG. 5 is a schematic view of the barrel extension.
Figure 6:
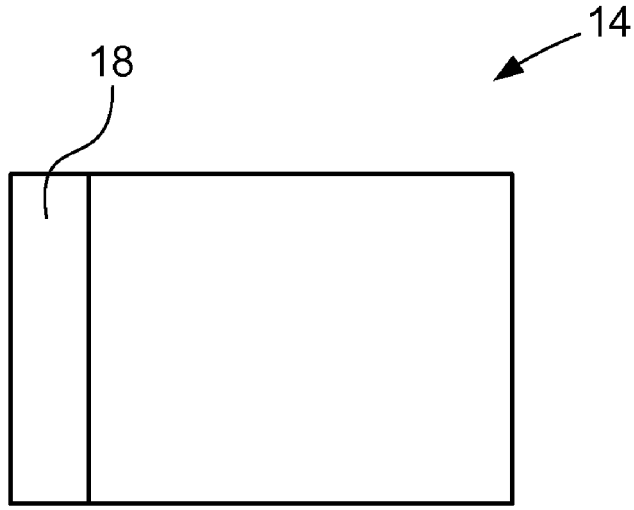
FIG. 6 is a schematic view of the barrel.

In the embodiment shown and described above, an intervening wall between primary chamber 24A and casing chamber 28 is in the form of a separate disk 18 which is interposed between primary chamber 24A and casing chamber 28. However, it is to be understood that the intervening wall with flash hole 30, and optionally nipple 32, can be integrally formed with barrel 14 or barrel extension 16 (as schematically shown in FIGS. 5 and 6). That is, barrel extension 16 can include a distal end which integrally includes a disk or wall with flash hole and optional nipple. Alternatively, barrel 14 can include a proximal or breach end which integrally includes a disk or wall with flash hole and optional nipple.

During use, the barrel is loaded as a muzzle loader in typical fashion. To that end, a selected powder charge such as pyrodex pellets 34 (FIG. 1), pyrodex powder or black powder is placed in the distal end of the barrel. Next, a projectile such as a saboted projectile 36, patched ball, mini ball, etc. is placed in the barrel and seated over the powder charge using a ramrod 38. One or more 0.223 casings 40 containing only a 209 primer are placed into the magazine, and the magazine is placed into the bottom of the lower receiver. The rifle is charged by drawing back the charge handle and pressing a release on the offside of the receiver. The safety is moved to the fire position and the weapon is ready to fire.

Although the present invention is shown and described above for use with a centerfire rifle in the form of a semi-automatic rifle, in particular an AR15, it should be understood that the present invention may be easily adapted to centerfire rifles with different types of actions, such as bolt action, pump action, lever action rifles or single shot rifles.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claim

What is claimed is:

1. A muzzleloading rifle, comprising:

an action;

a barrel assembly attached to a forward end of said action, said barrel assembly including a primary chamber for receiving a primary charge, a casing chamber positioned rearwardly from said primary chamber and including a proximal end and a distal end, said proximal end of said casing chamber configured to receive a standard ammunition casing with an integral primer therein, and an intervening wall separating said primary chamber from said casing chamber, said intervening wall including a flash hole communicating between said casing chamber and said primary chamber, said intervening wall including a nipple which projects into said casing chamber and which has a tip which is positioned proximate said distal end of said casing chamber and thereby opposite said proximal end of said casing chamber, said casing chamber being elongate.

2. The muzzleloading rifle of claim 1, wherein said barrel assembly includes a barrel and a barrel extension, said barrel including said primary chamber and said barrel extension including said casing chamber.

3. The muzzleloading rifle of claim 2, wherein said intervening wall is one of:

a disk interposed between said barrel extension and said barrel;

integral with said barrel extension; and integral with said barrel.

4. The muzzleloading rifle of claim 3, wherein said intervening wall is a disk which is seated within a pocket formed in said barrel, said disk being seated entirely within said barrel, said barrel including a transverse wall, at least a part of said disk being positioned between, and thereby being captured between, said barrel extension and said transverse wall.

5. The muzzleloading rifle of claim 4, wherein said barrel includes an internally threaded opening with a shoulder defining a seat for said disk, and said barrel extension includes an externally threaded projection which is threaded into said internally threaded opening in said barrel.

6. The muzzleloading rifle of claim 4, wherein said intervening wall includes said nipple which projects into said casing chamber to prevent said action from operating when a live round including a projectile is loaded into said primary chamber.

7. The muzzleloading rifle of claim 1, wherein said casing chamber is configured to receive one of a 0.223 inch, 0.243 inch, 0.270 inch, 0.308 inch (NATO or US), and 30-06 caliber casing.

8. The muzzleloading rifle of claim 1, wherein said casing chamber is configured to receive a casing with a centerfire primer for one of a shotgun, small rifle, large rifle, small pistol, large pistol, magnum small pistol, and magnum large pistol.

9. The muzzleloading rifle of claim 1, wherein said casing chamber is configured to receive a casing with a 209 shotgun primer.

10. The muzzleloading rifle of claim 1, wherein said action is one of a semi-automatic action, bolt action, pump action, lever action, and single shot action.

11. A muzzleloading rifle, comprising:

an action;

a barrel assembly attached to a forward end of said action, said barrel assembly including:

a barrel having a breach end and a muzzle end, said barrel including a primary chamber at said breach end for receiving a primary charge loaded through said muzzle end;

a barrel extension attached to said breach end of said barrel and including a casing chamber positioned rearwardly from said primary chamber, said casing chamber including a proximal end and a distal end, said proximal end of said casing chamber configured to receive a standard ammunition casing with an integral primer therein; and an intervening wall separating said primary chamber from said casing chamber, said intervening wall including a flash hole communicating between said casing chamber and said primary chamber, said intervening wall including a nipple which projects into said casing chamber and which has a tip which is positioned proximate said distal end of said casing chamber and thereby opposite said proximal end of said casing chamber, said casing chamber being elongate.

12. The muzzleloading rifle of claim 11, wherein said intervening wall is one of:

a disk interposed between said barrel extension and said barrel;

integral with said barrel extension; and integral with said barrel.

13. The muzzleloading rifle of claim 12, wherein said intervening wall is a disk which is seated within a pocket formed in said barrel, said disk being seated entirely within said barrel, said barrel including a transverse wall, at least a part of said disk being positioned between, and thereby being captured between, said barrel extension and said transverse wall.

14. The muzzleloading rifle of claim 13, wherein said barrel includes an internally threaded opening with a shoulder defining a seat for said disk, and said barrel extension includes an externally threaded projection which is threaded into said internally threaded opening in said barrel.

15. The muzzleloading rifle of claim 13, wherein said intervening wall includes said nipple which projects into said casing chamber to prevent said action from operating when a live round including a projectile is loaded into said primary chamber.

16. The muzzleloading rifle of claim 11, wherein said casing chamber is configured to receive one of a 0.223 inch, 0.243 inch, 0.270 inch, 0.308 inch (NATO or US), and 30-06 caliber casing.

17. The muzzleloading rifle of claim 11, wherein said casing chamber is configured to receive a casing with a centerfire primer for one of a shotgun, small rifle, large rifle, small pistol, large pistol, magnum small pistol, and magnum large pistol.

18. The muzzleloading rifle of claim 11, wherein said casing chamber is configured to receive a casing with a 209 shotgun primer.

19. The muzzleloading rifle of claim 11, wherein said action is one of a semi-automatic action, bolt action, pump action, lever action, and single shot action.

* * * * *